US011393330B2

(12) United States Patent
Son et al.

(10) Patent No.: US 11,393,330 B2
(45) Date of Patent: Jul. 19, 2022

(54) SURVEILLANCE SYSTEM AND OPERATION METHOD THEREOF

(71) Applicant: HANWHA TECHWIN CO., LTD., Seongnam-si (KR)

(72) Inventors: Myung Hwa Son, Seongnam-si (KR); Ye Un Jhung, Seongnam-si (KR); Jae Hyun Lim, Seongnam-si (KR); Min Suk Sung, Seongnam-si (KR)

(73) Assignee: HANWHA TECHWIN CO., LTD., Seongnam-si (KR)

( * ) Notice: Subject to any disclaimer, the term of this patent is extended or adjusted under 35 U.S.C. 154(b) by 0 days.

(21) Appl. No.: 16/929,330

(22) Filed: Jul. 15, 2020

(65) Prior Publication Data

US 2021/0020027 A1 Jan. 21, 2021

(30) Foreign Application Priority Data

Jul. 15, 2019 (KR) ..... 10-2019-0085203

(51) Int. Cl.
*G08C 17/02* (2006.01)

(52) U.S. Cl.
CPC ..... *G08C 17/02* (2013.01); *G08C 2201/34* (2013.01); *G08C 2201/61* (2013.01); *G08C 2201/70* (2013.01); *G08C 2201/93* (2013.01)

(58) Field of Classification Search
CPC ..... G08C 2201/34; G08C 2201/93; G08C 2201/30; H04N 21/42209; H04N 21/4316;

(Continued)

(56) References Cited

U.S. PATENT DOCUMENTS

2016/0212410 A1* 7/2016 Campbell ..... H04N 13/243
2017/0235999 A1* 8/2017 Chang ..... H04N 1/444 382/118

(Continued)

FOREIGN PATENT DOCUMENTS

JP 3680886 B2 8/2005
KR 1020060017156 A 2/2006

(Continued)

OTHER PUBLICATIONS

Communication dated Aug. 5, 2019 from the Korean Patent Office in application No. 10-2019-0085203.

(Continued)

*Primary Examiner* — Mirza F Alam
(74) *Attorney, Agent, or Firm* — Sughrue Mion, PLLC

(57) ABSTRACT

A user terminal includes: a communication interface configured to receive an image of a surveillance area, and transmit a control command to a first object; a display configured to display the image and a control tool regarding the first object; a user interface configured to receive a first user input to select the first object displayed in the image, and a second user input to control an operation of the first object; and a processor configured to: determine whether a user has a right to control the first object in response to the first user input; and based on determining that the user has the right to control the first object, display the control tool on the display, and generate the control command according to the second user input.

18 Claims, 7 Drawing Sheets

(58) Field of Classification Search
CPC ..... H04N 21/42204; G06F 3/04815; G06F 2203/04802
See application file for complete search history.

(56) References Cited

U.S. PATENT DOCUMENTS

| | | | | |
|---|---|---|---|---|
| 2017/0278365 | A1* | 9/2017 | Madar | G06K 7/1092 |
| 2019/0199932 | A1* | 6/2019 | Ida | G08B 13/19645 |
| 2019/0332901 | A1* | 10/2019 | Doumbouya | G06T 7/20 |

FOREIGN PATENT DOCUMENTS

| | | | |
|---|---|---|---|
| KR | 1020100008640 | A | 1/2010 |
| KR | 1020110067257 | A | 6/2011 |
| KR | 101272653 | B1 | 6/2013 |
| KR | 1020160113440 | A | 9/2016 |
| KR | 101847200 | B1 | 4/2018 |
| KR | 1020180094763 | A | 8/2018 |
| KR | 101972743 | B1 | 4/2019 |

OTHER PUBLICATIONS

Communication dated Oct. 8, 2019 from the Korean Patent Office in application No. 10-2019-0085203.

* cited by examiner

SURVEILLANCE SYSTEM AND OPERATION METHOD THEREOF

CROSS-REFERENCE TO THE RELATED APPLICATION

This application is based on and claims priority from Korean Patent Application No. 10-2019-0085203, filed on Jul. 15, 2019, in the Korean Intellectual Property Office, the disclosure of which is incorporated herein in its entirety by reference.

BACKGROUND

1. Field

One or more embodiments of the inventive concept relate to a surveillance system with enhanced security and an operation method thereof.

2. Description of Related Art

A surveillance system is operated in a method of tracking an object of interest, in which a user detects an image of a surveillance area received from a camera, and then, manually adjusts a rotation direction or a zoom ratio of the camera.

The surveillance system may provide not only a passive surveillance service such as provision of images, but also an active surveillance service of transmitting a warning to an object under surveillance through an image or restricting an action.

However, for security, the rights of the user who may use the active surveillance service need to be restricted.

SUMMARY

One or more embodiments provide a surveillance system which allows a user to access the surveillance system depending on the user's right to control an object controllable by a user terminal included in the surveillance system.

Various aspects of the embodiments will be set forth in part in the description which follows and, in part, will be apparent from the description, or may be learned by practice of the embodiments.

According to one or more embodiments, there is provided a user terminal which may include: a communication interface configured to receive an image of a surveillance area, and transmit a control command to a first object; a display configured to display the image and a control tool regarding the first object; a user interface configured to receive a first user input to select the first object displayed in the image, and a second user input to control an operation of the first object; and a processor configured to: determine whether a user has a right to control the first object in response to the first user input; and based on determining that the user has the right to control the first object, display the control tool on the display, and generate the control command according to the second user input.

The user terminal may further include a memory that previously stores biometric information corresponding to the first object, wherein the processor is further configured to: display a biometric information request message on the display in response to the first user input; receive a third user input corresponding to the biometric information request message through the user interface; and based on determining that biometric information included in the third user input matches the biometric information corresponding to the first object stored in the memory, determine that the user has the right to control the first object.

The biometric information included in the third user input may include at least one of fingerprint information, iris information, face information, and DNA information, and the user interface may include at least one of a fingerprint identification module, an iris identification module, a face identification module, and a DNA identification module.

The user terminal may further include a memory that previously stores information about a second object corresponding to the first object, wherein the processor is further configured to train an event regarding the second object based on a training image received for a certain period of time; detect an event related to the second object from the image based on the event training; and generate the control command according to the second user input using the control tool.

The processor may generate the control command directed to a surveillance camera capturing the image of the surveillance area, and control the communication interface to transmit the control command to the surveillance camera so that the surveillance camera controls the first object based on the control command. The first object may be an object of which an operation is directly controllable by the surveillance camera, and the second object may be an object of which an operation is not directly controllable by the surveillance camera.

The event may include at least one of presence, absence, a motion, and a motion stop of the second object.

According to one or more embodiments, there is provided a method of operating a user terminal. The method may include: receiving, by a communication interface, an image of a surveillance area captured by a surveillance camera; displaying, on a display, the image; receiving, by a user interface, a first user input to select a first object displayed in the image; determining, by a processor, whether a user has a right to control the first object in response to the first user input; based on determining that the user has the right to control the first object, displaying, on the display, a control tool regarding the first object; receiving, by the user interface, a second user input to control an operation of the first object by using the control tool; and transmitting, by the communication interface, a control command according to the second user input to the first object by way of the surveillance camera or directly.

The method may further include: previously storing, in a memory, biometric information corresponding to the first object, wherein the determining whether the user has the right to control the first object includes: displaying, on the display, a biometric information request message; receiving, by the user interface, a third user input corresponding to the biometric information request message; determining, by the processor, whether biometric information included in the third user input matches the biometric information corresponding to the first object stored in the memory; and based on determining that the biometric information included in the third user input matches the biometric information corresponding to the first object stored in the memory, determining, by the processor, that the user has the right to control the first object.

The biometric information included in the third user input may include at least one of fingerprint information, iris information, face information, and DNA information, and the user interface may include at least one of a fingerprint identification module, an iris identification module, a face identification module, and a DNA identification module.

The method may further include: previously storing in the memory, information about a second object corresponding to the first object; training, by the processor, an event regarding the second object based on a training image received for a certain period of time; and detecting an event related to the second object from the image, wherein the control tool regarding the first object is displayed on the display in response to the detecting the event, and the surveillance camera transmits the first object control command to the first object by using an infrared sensor.

The first object may be an object of which an operation is directly controllable by the surveillance camera, and the second object may be an object of which an operation is not directly controllable by the surveillance camera.

In an embodiment, the event may include at least one of presence, absence, a motion, and a motion stop of the second object.

According to one or more embodiments, there is provided a surveillance system which may include: a communication interface configured to receive an image of a surveillance area captured by a surveillance camera, and transmit a control command to a first object, according to a user input; a processor configured to: train an event regarding a second object corresponding to the first object based on a training image received for a certain period of time; detect an event related to the second object from the image based on the event training; display, on a display, a control tool regarding the first object; and generate the control command controlling the first object according to the user input; and a user interface configured to receive the user input to control an operation of the first object by using the control tool.

In an embodiment, the first object may be an object of which an operation is directly controllable by the surveillance camera, and the second object may be an object of which an operation is not directly controllable by the surveillance camera.

In an embodiment, the event may include at least one of presence, absence, a motion, and a motion stop of the second object.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
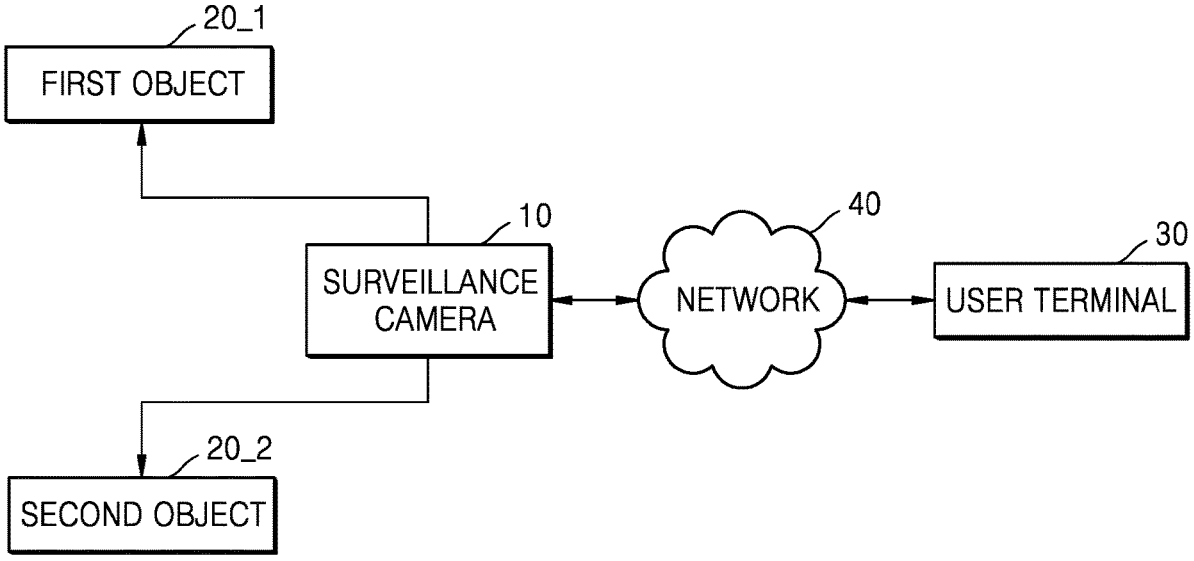
FIG. 1 illustrates a surveillance environment to which a surveillance system according to one or more embodiments is applied.

Reference will now be made in detail to embodiments which are illustrated in the accompanying drawings, wherein like reference numerals refer to like elements throughout. In this regard, the present embodiments are all example embodiment, and thus, may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

In the description of the embodiments, certain detailed explanations of the related art are omitted when it is deemed that they may unnecessarily obscure the essence of the disclosure.

While such terms as "first," "second," etc., may be used to describe various components, such components must not be limited to the above terms. The above terms are used only to distinguish one component from another.

The terms used in the specification are merely used to describe embodiments, and are not intended to limit the inventive concept. An expression used in the singular encompasses the expression of the plural, unless it has a clearly different meaning in the context. In the specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Figure 2:
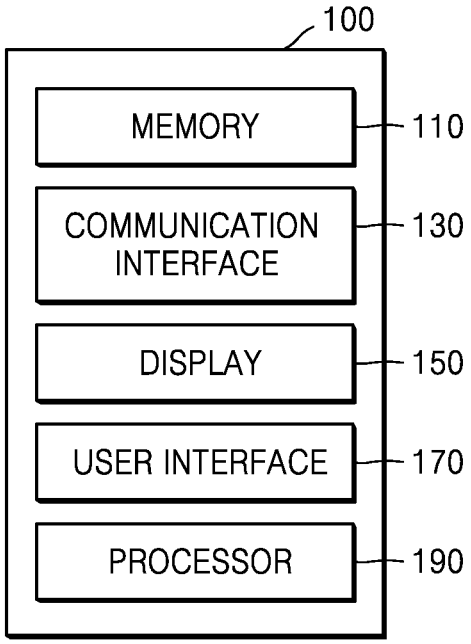
FIG. 2 is a block diagram of a configuration of a surveillance system according to one or more embodiments.

At least one of the components, elements, modules or units (collectively "components" in this paragraph) represented by a block in the drawings, e.g., a processor 190 shown in FIG. 2, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

FIG. 1 illustrates a surveillance environment to which a surveillance system according to one or more embodiments is applied.

Referring to FIG. 1, a surveillance environment to which a surveillance system according to one or more embodiments is applied may include a surveillance camera 10, a first object 20-1, a second object 20-2, a user terminal 30, and a network 40.

The surveillance camera 10 captures an image or image data (hereafter collectively "image") of a surveillance area, and transmits the image to the user terminal 30 via the network 40.

The surveillance area of the surveillance camera 10 may be fixed or changed.

The surveillance camera 10 may be a closed circuit television (CCTV), a pan-tilt-zoom (PTZ) camera, a fisheye camera, or a drone, but not being limited thereto.

The surveillance camera 10 may be a low-power camera driven by a battery. The surveillance camera 10 may normally maintain a sleep mode, and may periodically wake up to check whether an event has occurred. The surveillance camera 10 may be switched to an active mode when an event occurs, and may return to a sleep mode when no event occurs. As such, as an active mode is maintained only when an event occurs, the power consumption of the surveillance camera 10 may be reduced.

The surveillance camera 10 may include one or more surveillance cameras.

The surveillance camera 10 may include an infrared sensor. The surveillance camera 10 may directly control an operation of the first object 20-1 by transmitting a control command to the first object 20-1 by using the infrared sensor. For example, the surveillance camera 10 may turn the first object 20-1 off by transmitting a power turn-off command to the first object 20-1 by using the infrared sensor. Herein, the term "command" may refer to a wired or wireless signal such as a radio frequency (RF) signal, an optical signal, not being limited thereto, that includes the command.

The surveillance camera 10 may indirectly control an operation of the second object 20-2 by transmitting a control command to the first object 20-1. For example, the surveillance camera 10 may send a warning to the second object 20-2 by transmitting an alarm-on command to the first object 20-1 by using the infrared sensor.

The first object 20-1 may be a direct control object that is directly controllable by the surveillance camera 10, and the second object 20-2 may be an indirect control object that is not directly controlled by the surveillance camera 10.

The first object 20-1 may be a device, for example, a television (TV), a refrigerator, an air conditioner, a vacuum cleaner, or a smart device, not being limited thereto, of which an operation is controlled by a signal from the infrared sensor.

The second object 20-2 may be an object, for example, a mobile object, of which presence, absence, a motion, or a motion stop may be recognized as an event.

Embodiments provide a surveillance system that indirectly controls the motions of the second object 20-2 by directly controlling the operation of the first object 20-1.

The user terminal 30 may communicate with the surveillance camera 10 via the network 40. For example, the user terminal 30 may receive an image from the surveillance camera 10, and transmit a control command to the surveillance camera 10. The user terminal 30 may include at least one processor. The user terminal 30 may be driven by being included in other hardware devices such as a microprocessor or a general-purpose computer system. The user terminal 30 may be a personal computer or a mobile device.

The user terminal 30 may include a user interface such as keyboard, mouse, touch pad, scanner, not being limited thereto, for controlling operations of the surveillance camera 10 and/or the first object 20-1.

The network 40 may include a wired network or a wireless network.

The surveillance system according to embodiment may be implemented as one physical device or by being organically combined with a plurality of physical devices. To this end, some of the features of the surveillance system may be implemented or installed as any one physical device, and the other features thereof may be implemented or installed as another physical device. Here, any one physical device may be implemented as a part of the surveillance camera 10, and other physical devices may be implemented as a part of the user terminal 30.

The surveillance system may be included in the surveillance camera 10 and/or the user terminal 30, or may be applied to a device separately provided from the surveillance camera 10 and/or the user terminal 30.

FIG. 2 is a block diagram of a configuration of a surveillance system according to one or more embodiments.

Referring to FIGS. 1 and 2, a surveillance system 100 according to one or more embodiments may include a memory 110, a communication interface 130, a display 150, a user interface 170, and a processor 190.

The memory 110 previously stores biometric information corresponding to the first object 20-1.

The biometric information corresponding to the first object 20-1 may be biometric information about a user having a right to control the first object 20-1. The biometric information may include at least one of fingerprint information, iris information, face information, and DNA information of the user, not being limited thereto.

The memory 110 previously stores information about the first object 20-1 and the second object 20-2 corresponding to the first object 20-1. Here, the information about the first object 20-1 and the second object 20-2 may include one or more identifiers or attributes thereof such as image, text, symbol, size, color, location, etc., not being limited thereto.

The second object 20-2 corresponding to the first object 20-1 may be an object that is affected by the operation of the first object 20-1. The second object 20-2 corresponding to the first object 20-1 may be previously determined by a user having the right to control the first object 20-1 or may be an object of which presence, absence, a motion, or a motion stop may be recognized.

The communication interface 130 may receive an image of a surveillance area that is captured by the surveillance camera 10, and transmit a first object control command to the surveillance camera 10. The communication interface 130 may include any one or any combination of a digital modem, a radio frequency (RF) modem, a WiFi chip, and related software and/or firmware, not being limited thereto.

The first object control command may be a certain operation performance command with respect to the first object 20-1, and may be transmitted to the first object 20-1 by the infrared sensor.

The display 150 displays an image, a control tool regarding the first object 20-1, a biometric information request message, etc. The display 150 may include a liquid crystal display (LCD), a light-emitting diode (LED) display, or an organic light-emitting diode (OLED) display not being limited thereto.

The control tool regarding the first object 20-1 may include, for example, a power button, a channel change button, an option change button, a volume control button, an intensity control button, and/or a temperature control button, not being limited thereto.

The biometric information request message may be a message requesting an input of, for example, a fingerprint, an iris, a face, and/or DNA information of a user, not being limited thereto.

The user interface 170 may receive a first user input to select the first object 20-1 displayed in the image, a second user input to control the operation of the first object 20-1 by using the control tool, and a third use input corresponding to the biometric information request message.

The first user input to select the first object 20-1 displayed in the image may be, for example, a user input that touches an area of a screen of the display 150 where the first object 20-1 is displayed, but the inventive concept is not limited thereto. According to an embodiment, a more intuitive user interface may be provided. For example, the display 150 may display a different identifier such as a text or a symbol of the first object 20-1 separately from the image, and the user may select the first object 20-1 by touching the identifier.

The second user input to control the operation of the first object 20-1 by using the control tool may include, for example, a user input that touches the power button, the channel change button, the option change button, the volume control button, the intensity control button, and/or the temperature control button, which are displayed on the screen of the display 150, but the inventive concept is not limited thereto. According to an embodiment, the first object 20-1 may be remotely controlled.

The user interface 170 may include a keyboard, a mouse, a touch pad, and/or a scanner, not being limited thereto, to receive the first, second and third user inputs. The user interface 170 may further include a fingerprint identification module, an iris identification module, a face identification module, and/or a DNA identification module, not being limited thereto, which may be implemented by one or more hardware and/or software modules such as a microprocessor with embedded software. The third user input corresponding to the biometric information request message may be an input of, for example, fingerprint information, iris information, face information, and/or DNA information, but the inventive concept is not limited thereto. According to an embodiment, as only a user having a control right may control the operation of the first object 20-1, a surveillance system with enhanced security may be provided.

The processor 190 determines, in response to the first user input, whether a user has a right to control the first object 20-1, and when it is determined that the user has a right to control the first object 20-1, the processor 190 displays the control tool on the display 150, and generates the first object control command according to the second user input.

The processor 190 according to one or more embodiments may display, in response to the first user input, the biometric information request message on the display 150, receive through the user interface 170 the third user input corresponding to the biometric information request message, and when the biometric information included in the third user input matches the biometric information corresponding to the first object 20-1 stored in the memory 110, may determine that the user has a right to control the first object 20-1.

The biometric information included in the third user input may include fingerprint information, iris information, face information, and/or DNA information, not being limited thereto.

The processor 190 according to one or more embodiments may train an event regarding the second object 20-2 based on a training image received for a certain period of time, and when the processor 190 detects an event related to the second object 20-2 from an image received after the certain period of time based on the training, may extract from the memory 110 the information about the first object 20-1 related to the second object 20-2, display the control tool regarding the first object 20-1 on the screen of the display 150, and when a fourth user input to control the operation of the first object 20-1 by using the control tool is received through the user interface 170, may generate the first object control command according to the fourth user input. Here, the fourth user input may be the same as or included in the second user input described above.

The processor 190 may train a behavior pattern of the second object 20-2 from a training image received for the certain period of time. The processor 190 may train an event based on the behavior pattern of the second object 20-2. For example, the processor 190 may train presence, absence, a motion, or a motion stop of the second object 20-2 as an event.

When the event related to the second object 20-2 is detected from an image received after the certain period of time, the processor 190 may provide a user with the control tool for direct control of the first object 20-1 related to the second object 20-2 to indirectly control the operation of the second object 20-2.

As the information about the second object 20-2 corresponding to the first object 20-1 is previously stored in the memory 110, the processor 190 may extract, from the memory 110, the information about first object 20-1 related to the second object 20-2.

For example, when the first object 20-1 is a speaker, the second object 20-2 corresponding to the first object 20-1 is a garbage bag, and an event is the presence of the second object 20-2, the processor 190 may detect, as an event, appearance of a garbage bag from an image of a surveillance area, and extract, from the memory 110, the information about the speaker related to the garbage bag.

Here, the processor 190 may display, on the screen of the display 150, a talk or alarm selection button, a direction control button and/or a volume control button, as a control tool for controlling the speaker, and when the user interface 170 receives the fourth user input to select an alarm selection button, may generate a speaker control command for an alarm output.

A method of operating a surveillance system according to one or more embodiments is described below in detail with reference to FIGS. 3 to 5.

Figure 3:
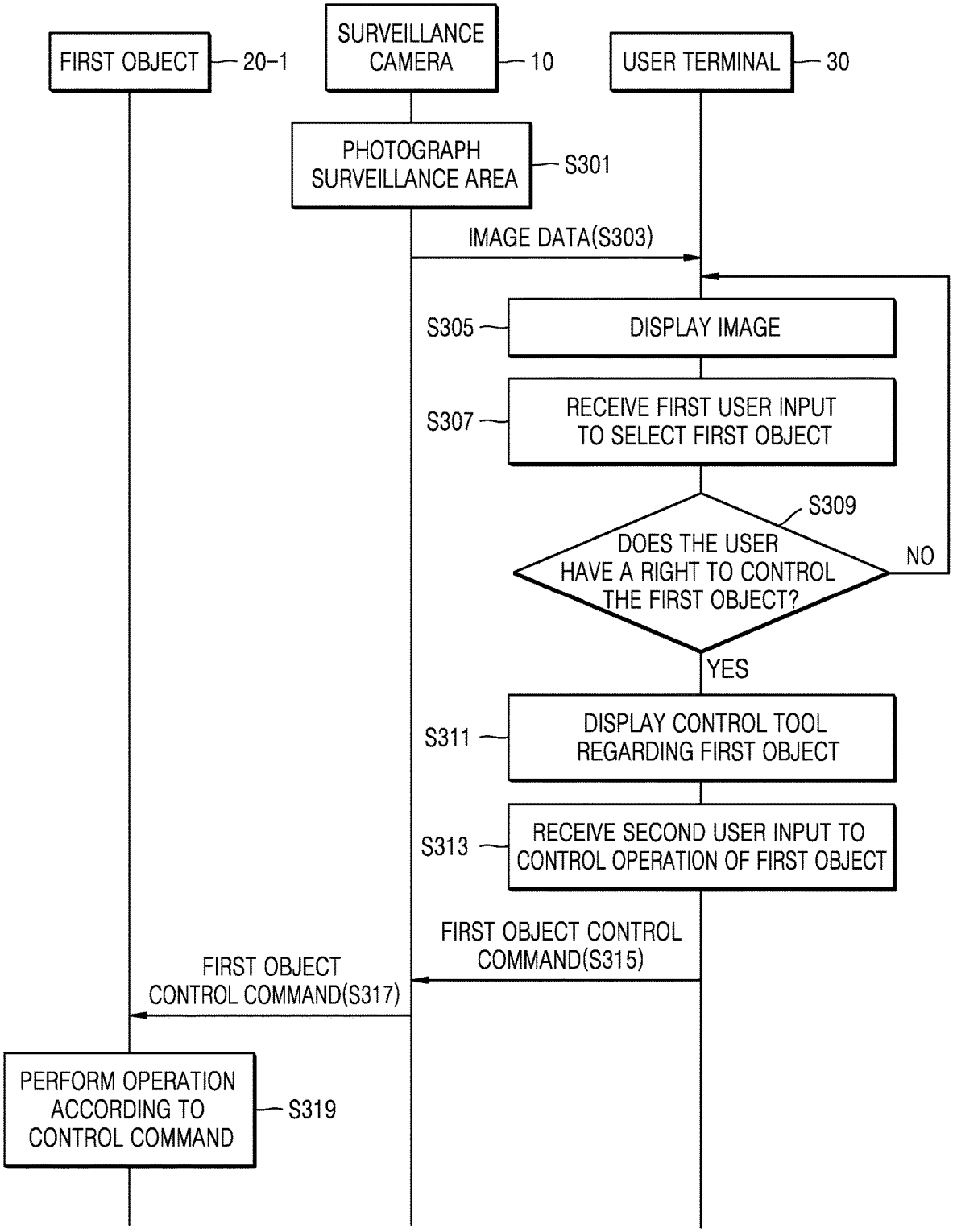
FIG. 3 is a flowchart of a method of operating a surveillance system according to one or more embodiments.

FIG. 3 is a flowchart of a method of operating a surveillance system according to one or more embodiments.

Figure 4:
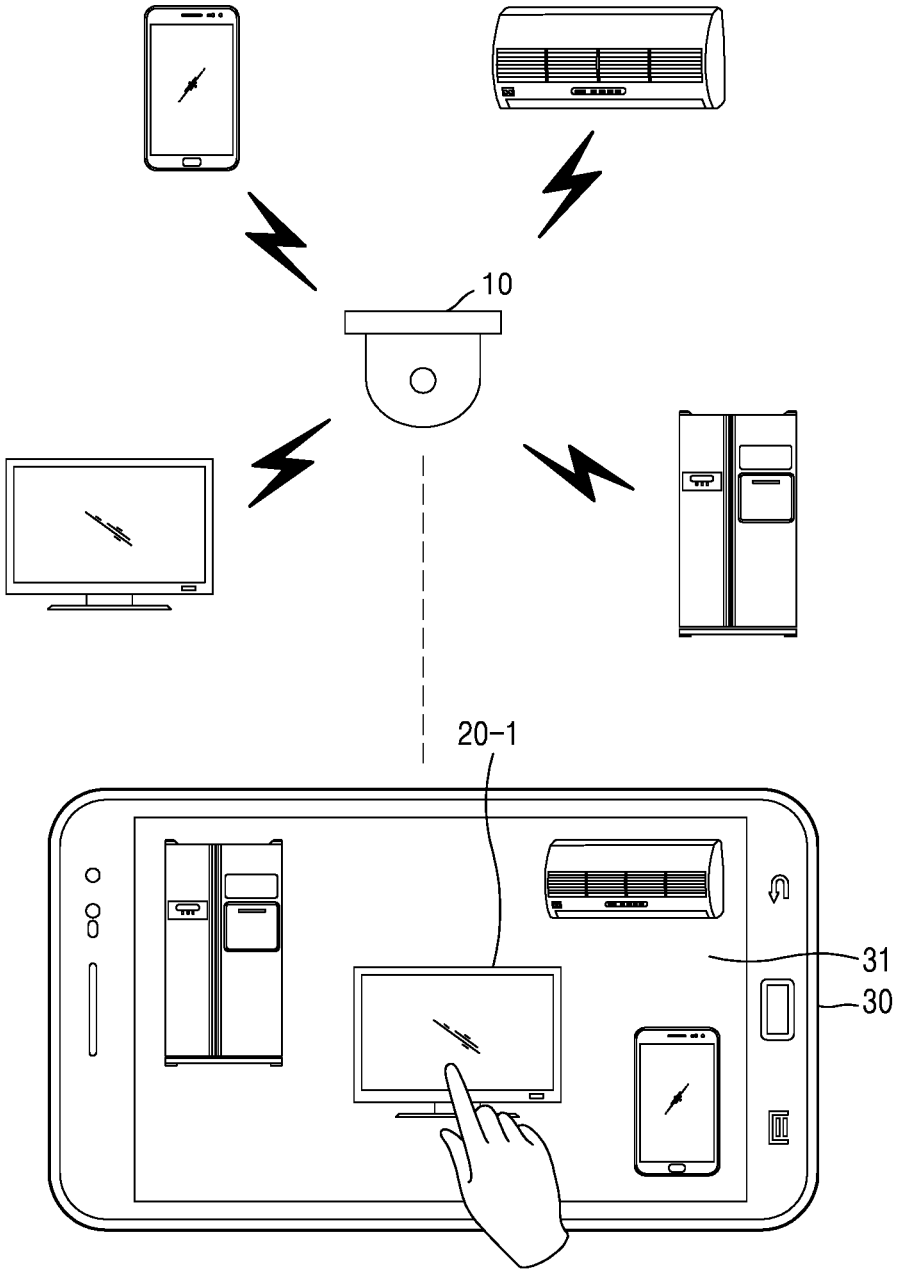
FIG. 4 illustrates a method of operating a surveillance system according to one or more embodiments.

FIG. 4 illustrates a method of operating a surveillance system according to one or more embodiments.

Figure 5:
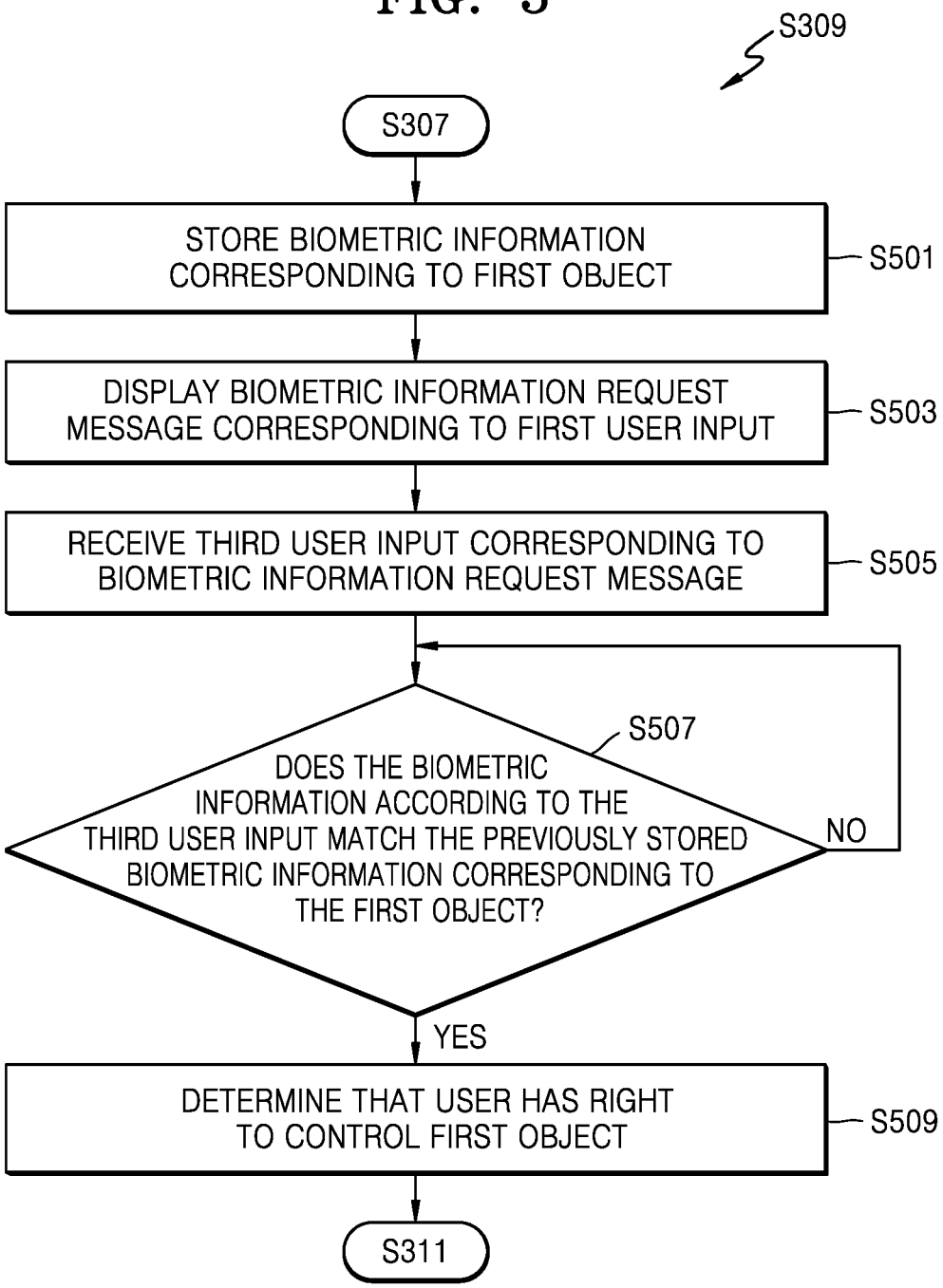
FIG. 5 is a flowchart of a method of determining an object control right of a surveillance system according to one or more embodiments.

FIG. 5 is a flowchart of a method of determining an object control right of a surveillance system according to one or more embodiments.

Referring to FIGS. 3 to 5, the surveillance camera 10 photographs a surveillance area (S301). The surveillance area may be indoor or outdoor, or fixed or changed.

When the surveillance camera 10 photographs the surveillance area, an image regarding the surveillance area may be generated. The surveillance camera 10 may photograph a TV, a refrigerator, an air conditioner, or a smart device, which corresponds to the first object 20-1, thereby generating the image.

Next, when the surveillance camera 10 transmits the image to the user terminal 30 (S303), the user terminal 30 displays the image (S305).

For example, the image may show children in front of a TV.

When the first user input selecting the first object 20-1 displayed in the image is received (S307), the user terminal 30 determines, in response to the first user input, whether a user has a right to control the first object 20-1 (S309).

For example, when a first user input that touches an area on a screen 31, where a TV that is the first object 20-1 is displayed is received, the user terminal 30 may determine whether the user has the right to control the TV that is the first object 20-1.

According to an embodiment for determining whether to have the right to control the first object 20-1, the user terminal 30 previously stores the biometric information corresponding to the first object 20-1 (S501), and displays, in response to the first user input, a biometric information request message on the screen 31 (S503).

For example, parent's fingerprint information corresponding to a TV may be previously stored in the user terminal 30, and the user terminal 30 may display the fingerprint information request message on the screen 31 in response to the user input that selects the TV.

Next, when the third user input corresponding to the biometric information request message is received (S505), the user terminal 30 may determine whether the biometric information included in the third user input matches the previously stored biometric information corresponding to the first object 20-1 (S507).

For example, the user terminal 30, when receiving the third user input, may determine whether the fingerprint information included in the third user input matches the previously stored parent's fingerprint information corresponding to a TV. The user terminal 30 may obtain the fingerprint information by using a fingerprint sensor.

Next, when the biometric information included in the third user input matches the previously stored biometric information corresponding to the first object 20-1, the user terminal 30 determines that the user has the right to control the first object 20-1 (S509).

For example, when the fingerprint information included in the third user input matches the previously stored parent's fingerprint information corresponding to a TV, the user terminal 30 may determine that the user has the right to control a TV because the third user input corresponds to an input by parents.

When the user has the right to control the first object 20-1, the user terminal 30 displays the control tool regarding the first object 20-1 on the screen 31 (S311), and when the second user input to control the operation of the first object 20-1 by using the control tool is received (S313), the user terminal 30 transmits the first object control command according to the second user input to the surveillance camera 10 (S315).

For example, when the user is approved to have the right to control a TV, the user terminal 30 may display a control tool regarding a TV on the screen 31, and when receiving a second user input to turn off a power of a TV through the control tool regarding a TV, the user terminal 30 may transmit a power turn-off command with respect to the TV to the surveillance camera 10.

Next, when the surveillance camera 10 transmits the first object control command to the first object 20-1 (S317), the first object 20-1 performs an operation according to the first object control command (S319).

For example, when the surveillance camera 10 transmits the power turn-off command to the TV, the TV may be turned off. According to an embodiment, parents may monitor whether children are currently in front of a TV based on an image, and furthermore may indirectly control the children's behavior by turning the TV off after receiving an approval of his/her right to control to control the TV, thereby providing a surveillance system with enhanced security and active controllability.

A method of operating a surveillance system according to one or more embodiments is described below in detail with reference to FIGS. 6 and 7.

Figure 6:
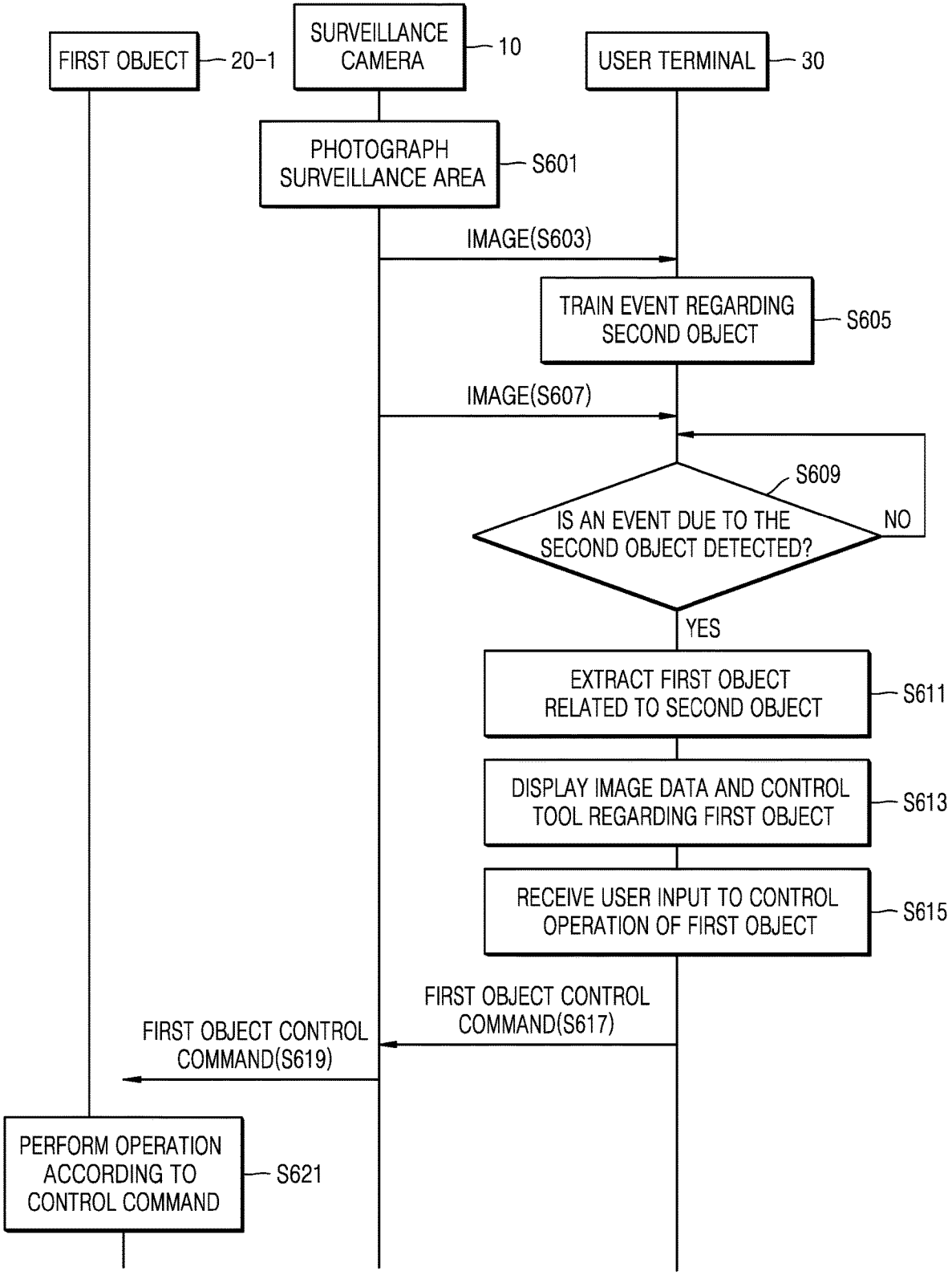
FIG. 6 is a flowchart of a method of detecting an event of a surveillance system according to one or more embodiments.

FIG. 6 is a flowchart of a method of detecting an event of a surveillance system according to one or more embodiments.

Figure 7:
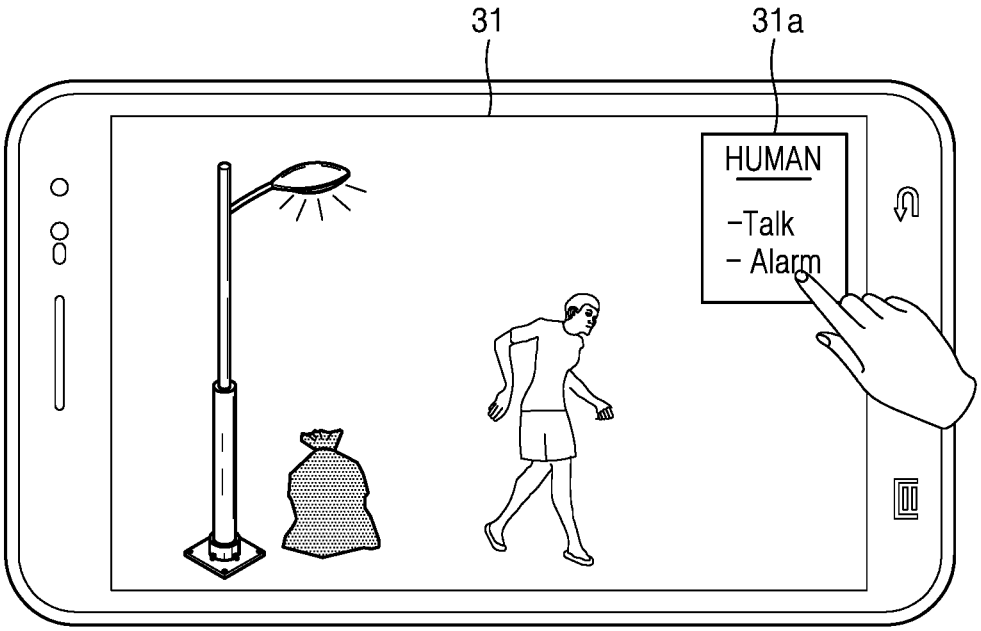
FIG. 7 illustrates an event related screen of a surveillance system according to one or more embodiments.

FIG. 7 illustrates an event related screen of a surveillance system according to one or more embodiments.

Referring to FIGS. 6 and 7, the surveillance camera 10 photographs a surveillance area (S601).

Next, when the surveillance camera 10 transmits an image to the user terminal 30 (S603), the user terminal 30 trains an event regarding the second object 20-2 based on a training image received for a certain period of time (S605).

The user terminal 30 may train presence, absence, a motion, or a motion stop of the second object 20-2 as an event.

For example, the user terminal 30 may train an event that no garbage bag is present in a certain area based on a training image received for a certain period of time.

The user terminal 30 may previously store information about the second object 20-2 corresponding to the first object 20-1. The user terminal 30 may designate the second object 20-2 according to a user's selection, and extract the information about the second object 20-2 related to the location and function of the first object 20-1 by training the training image of the surveillance camera 10, but the inventive concept is not limited thereto.

For example, the user terminal 30 may store an image of a speaker as the first object 20-1 corresponding to the garbage bag.

Next, the user terminal 30 receives an image from the surveillance camera 10 after a certain period of time (S607), and when an event related to the second object 20-2 is detected from the image (S609), the user terminal 30 extracts information about the first object 20-1, which is previously stored, related to the second object 20-2 (S611).

For example, the user terminal 30 may detect an event where a garbage bag is present in a certain area, from the image received after a certain period of time, and extract information about a speaker related to the presence of the garbage bag Next, the user terminal 30 displays a control tool 31*a* regarding the first object 20-1 on the screen 31 (S613).

For example, when the first object 20-1 is a speaker, the control tool 31*a* may include a pop-up window including information about the second object 20-2, a talk selection button, and an alarm selection button. The user terminal 30 may inform a user that an event is generated by the second object 20-2, and propose an action that the user may take by using the first object 20-1 in response to the event, by displaying the control tool 31*a* on the screen 31 in response to the event.

Next, the user terminal 30 receives a user input to control an operation of the first object 20-1 by using the control tool 31*a* (S615).

For example, the user terminal 30 may receive a user input that touches an alarm selection button of the control tool 31*a* displayed on the screen 31.

Accordingly, the user terminal 30 transmits to the surveillance camera 10 a first object control command according to the user input (S617).

For example, the user terminal 30 may transmit the first object control command to the surveillance camera 10 to activate an alarm output function of the first object 20-1.

The surveillance camera 10 transmits the first object control command to the first object 20-1 by using the infrared sensor (S619), and the first object 20-1 performs an operation according to the first object control command (S621).

For example, when the surveillance camera 10 transmits to the first object 20-1 the first object control command that activates the alarm output function of the first object 20-1, the first object 20-1 may output an alarm according to the first object control command. In other words, when the presence of a garbage bag is detected in a certain area, the surveillance camera 10 outputs an alarm toward an area included in the certain area through the speaker to warn one who illegally disposed of a garbage bag that the certain area is not a garbage bag disposal area.

According to embodiments, a more intuitive user interface may be provided.

While devices, such as the first object 20-1, disposed around a surveillance camera may be remotely controlled by using the surveillance camera according to the above embodiments, these devices may be directly controlled by a user terminal. In other words, according to an embodiment, a control command controlling these devices may be transmitted to these devices not by way of the surveillance camera but directly to the devices to simplify the control process.

As devices around a surveillance camera are controlled by only a user having a control right according to the above embodiments, a surveillance system with enhanced security may be provided.

Furthermore, a more efficient surveillance system may be provided by directly controlling a controllable device and indirectly controlling the operation of an uncontrollable object.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the inventive concept as defined by the following claims.

What is claimed is:

1. A user terminal comprising:

a communication interface configured to receive an image of a surveillance area, and transmit a control command to a first object;

a display configured to display the image and a control tool regarding the first object;

a user interface configured to receive a first user input to select the first object displayed in the image, and a second user input to control an operation of the first object; and a processor configured to:

determine whether a user has a right to control the first object in response to the first user input; and based on determining that the user has the right to control the first object, display the control tool on the display, and generate the control command according to the second user input, wherein the user terminal further comprises a memory that previously stores information about a second object corresponding to the first object, and wherein the processor is further configured to:

train an event regarding the second object based on a training image received for a certain period of time;

based on detecting an event related to the second object from the image based on the event training, display the control tool regarding the first object on the display; and generate the control command according to the second user input using the control tool.

2. The user terminal of claim 1, wherein the processor is configured to generate the control command directed to a surveillance camera capturing the image of the surveillance area, and control the communication interface to transmit the control command to the surveillance camera so that the surveillance camera controls the operation of the first object based on the control command.

3. The user terminal of claim 1, wherein the image is captured by a surveillance camera, and wherein the processor is configured to generate the control command directed to the first object, and control the communication interface to transmit the control command not by way of the surveillance camera but directly to the first object to directly control the operation of the first object.

4. The user terminal of claim 1, wherein the control tool is used to control the operation of the first object, and comprises at least one of a power control button, a channel change button, an option change button, a volume control button, an intensity control button, and a temperature control button.

5. The user terminal of claim 1, further comprising a memory that previously stores biometric information corresponding to the first object, wherein the processor is further configured to:

display a biometric information request message on the display in response to the first user input;

receive a third user input in response to the biometric information request message through the user interface; and based on determining that biometric information included in the third user input matches the biometric information corresponding to the first object stored in the memory, determine that the user has the right to control the first object.

6. The user terminal of claim 5, wherein the biometric information included in the third user input comprises at least one of fingerprint information, iris information, face information, and DNA information, and wherein the user interface comprises at least one of a fingerprint identification module, an iris identification module, a face identification module, and a DNA identification module.

7. The user terminal of claim 1, wherein the processor is configured to generate the control command directed to a surveillance camera capturing the image of the surveillance area, and control the communication interface to transmit the control command to the surveillance camera so that the surveillance camera controls the first object based on the control command.

8. The user terminal of claim 7, wherein the first object is an object of which an operation is directly controllable by the surveillance camera, and wherein the second object is an object of which an operation is not directly controllable by the surveillance camera.

9. The user terminal of claim 1, wherein the image is captured by a surveillance camera, and wherein the processor is configured to generate the control command directed to the first object, and control the communication interface to transmit the control command not by way of the surveillance camera but directly to the first object to directly control the operation of the first object.

10. The user terminal of claim 1, wherein the event comprises at least one of presence, absence, a motion, and a motion stop of the second object.

11. A method of operating a user terminal, the method comprising:

receiving, by a communication interface, an image of a surveillance area captured by a surveillance camera;

displaying, on a display, the image;

receiving, by a user interface, a first user input to select a first object displayed in the image;

determining, by a processor, whether a user has a right to control the first object in response to the first user input;

based on determining that the user has the right to control the first object, displaying, on the display, a control tool regarding the first object;

receiving, by the user interface, a second user input to control an operation of the first object by using the control tool; and transmitting, by the communication interface, a control command according to the second user input to the first object by way of the surveillance camera or directly, wherein the method further comprises:

previously storing, in a memory, information about a second object corresponding to the first object;

training, by the processor, an event regarding the second object based on a training image received for a certain period of time; and detecting an event related to the second object from the image, wherein the control tool regarding the first object is displayed on the display in response to the detecting the event, and wherein the surveillance camera transmits the control command to the first object by using an infrared sensor included in the surveillance camera.

12. The method of claim 11, further comprising previously storing, in a memory, biometric information corresponding to the first object, wherein the determining whether the user has the right to control the first object comprises:

displaying, on the display, a biometric information request message;

receiving, by the user interface, a third user input in response to the biometric information request message;

determining, by the processor, whether biometric information included in the third user input matches the biometric information corresponding to the first object stored in the memory; and based on determining that the biometric information included in the third user input matches the biometric information corresponding to the first object stored in the memory, determining, by the processor, that the user has the right to control the first object.

13. The method of claim 12, wherein the biometric information included in the third user input comprises at least one of fingerprint information, iris information, face information, and DNA information, and wherein the user interface comprises at least one of a fingerprint identification module, an iris identification module, a face identification module, and a DNA identification module.

14. The method of claim 11, wherein the first object is an object of which an operation is directly controllable by the surveillance camera, and wherein the second object is an object of which an operation is not directly controllable by the surveillance camera.

15. The method of claim 9, wherein the event comprises at least one of presence, absence, a motion, and a motion stop of the second object.

16. A surveillance system comprising:

a communication interface configured to receive an image of a surveillance area captured by a surveillance camera, and transmit a control command to a first object, according to a user input;

a processor configured to:

train an event regarding a second object corresponding to the first object based on a training image received for a certain period of time;

detect an event related to the second object from the image based on the event training;

display, on a display, a control tool regarding the first object; and generate the control command controlling the first object according to the user input; and a user interface configured to receive the user input to control an operation of the first object by using the control tool.

17. The surveillance system of claim 12, wherein the first object is an object of which an operation is directly controllable by the surveillance camera, and wherein the second object is an object of which an operation is not directly controllable by the surveillance camera.

18. The surveillance system of claim 12, wherein the event comprises at least one of presence, absence, a motion, and a motion stop of the second object.

* * * * *